United States Patent [19]

Brunning

[11] 4,396,558

[45] Aug. 2, 1983

[54] AUTOMATIC CHOKE

[75] Inventor: John F. Brunning, Billericay, England

[73] Assignee: Ford Motor Company, Dearborn, Mich.

[21] Appl. No.: 335,138

[22] Filed: Dec. 28, 1981

Related U.S. Application Data

[63] Continuation of Ser. No. 239,097, Feb. 27, 1981, abandoned.

[30] Foreign Application Priority Data

Feb. 28, 1980 [GB] United Kingdom ..... 8006792

[51] Int. Cl.[3] ..... F02M 1/06

[52] U.S. Cl. ..... 261/39 D; 261/44 F; 261/50 A

[58] Field of Search ..... 261/39 D, 50 A, 44 F

[56] References Cited

U.S. PATENT DOCUMENTS 3,695,591 10/1972 Caisley ..... 261/39 D
3,957,026 5/1976 Winkley et al. ..... 261/39 D
4,094,931 6/1978 Karino ..... 261/39 D
4,172,864 10/1979 Hohsho et al. ..... 261/39 D

FOREIGN PATENT DOCUMENTS 1364052 8/1974 United Kingdom ..... 261/39 D

*Primary Examiner*—Tim R. Miles
*Attorney, Agent, or Firm*—Robert E. McCollum; Clifford L. Sadler

[57] ABSTRACT

An automatic choke for a carburetor comprises a fuel enrichment valve (59, 60) for controlling the flow of fuel into a carburetor, a first operating lever (54) movable by a temperature sensitive element, e.g. a bimetallic coil spring, into engagement with an end stop (100); a second operating lever (57) for opening and closing the fuel enrichment valve (59, 60); a resilient connection, e.g. a coaxial coil spring (64), between the first and second levers (54, 57) by which the first lever moves the second lever to open the fuel enrichment valve at low temperatures; and an override lever (72) operable by a vacuum control device (73–80) to move the second lever against the bias of the resilient connection to close the fuel enrichment valve at low temperatures and low engine loads.

3 Claims, 12 Drawing Figures

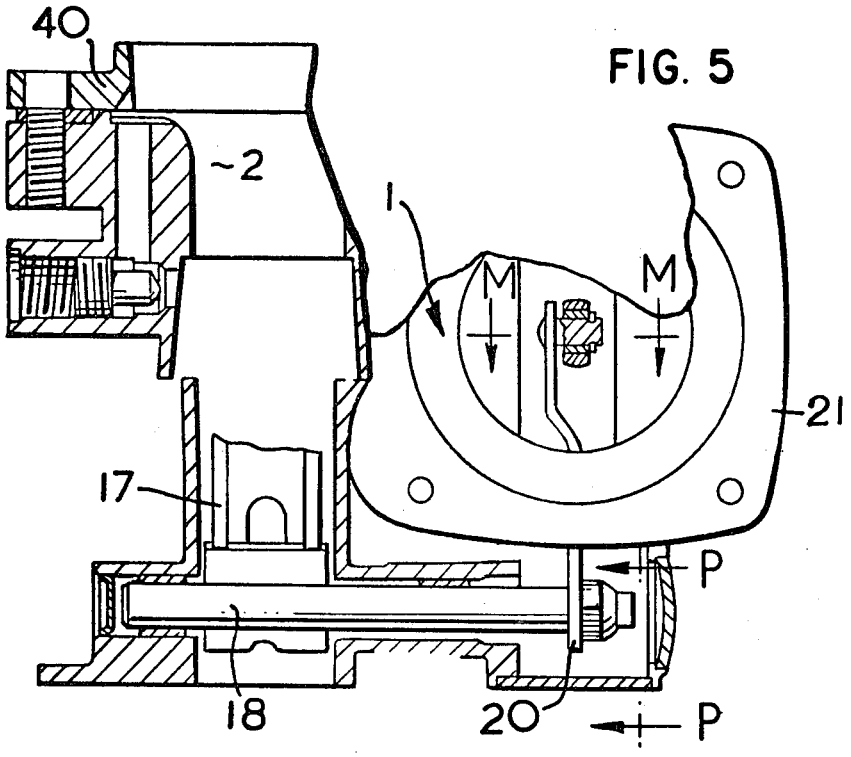
FIG. 5
FIG. 6
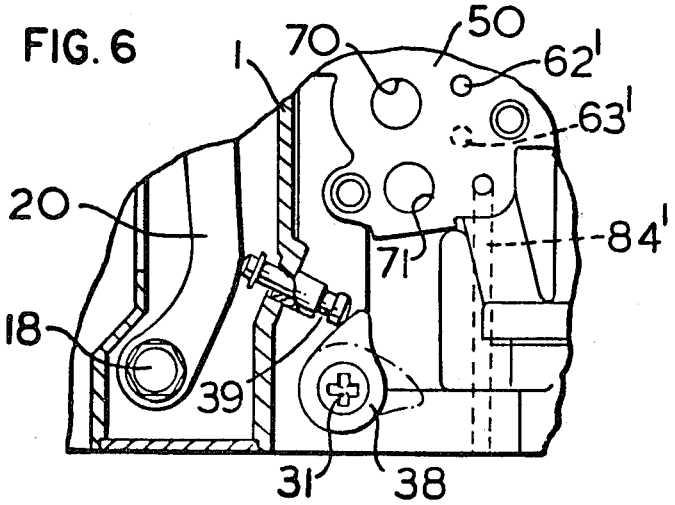

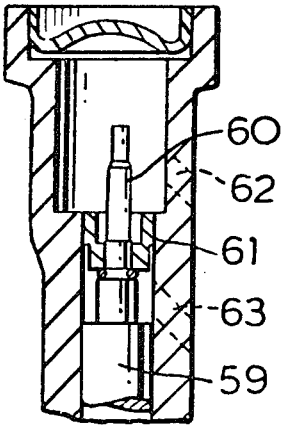
FIG. 8
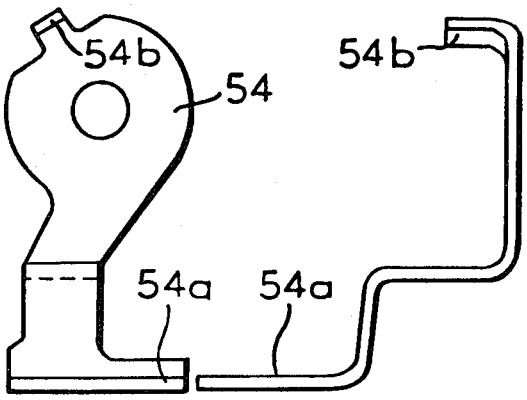
FIG. 12
FIG. 9
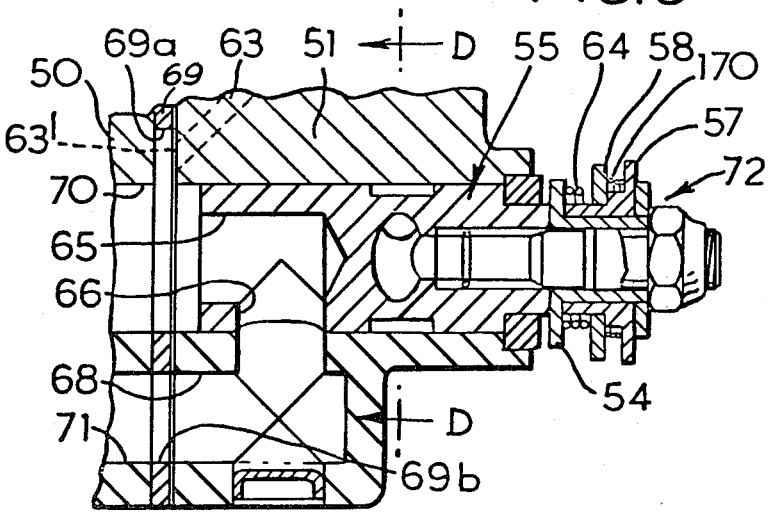

AUTOMATIC CHOKE

This is a Continuation of application Ser. No. 239,097, filed Feb. 27, 1981, now abandoned.

DESCRIPTION

This invention relates to automatic chokes for carburettors.

U.S. Ser. No. 270,532, a PCT application PCT/US/7900613 to Inkpen et al, filed Apr. 18, 1980, is assigned to the assignee of this invention. It discloses a carburetor having an automatic choke of a general construction similar to the choke of this invention. It includes a fuel enrichment valve 60 for controlling the flow of fuel into the carburetor; a bimetallic temperature sensitive coil element 53; a first operating lever 54 movable by the temperature sensitive element into engagement with an end stop at low temperatures; a second operating lever 57 for opening and closing the fuel enrichment valve 60 and movable by the first operating lever 54 so as to open the fuel enrichment valve as the first operating lever moves towards the end stop; and an override lever **72*a* movable by a vacuum operated control device 73 in response to vacuum in the manifold of the engine to which the carburetor is attached. At low temperatures, the override lever 72*a* acts upon the first operating lever 54 to move it away from the end stop so that the fuel enrichment valve 60** closes when a high vacuum is applied to the vacuum control device. In this way, the amount of additional fuel supplied to the engine by the fuel enrichment valve under low engine loads (e.g. when the engine is idling) is reduced.

In order to move the first operating lever 54 out of engagement with the end stop, the force exerted on the first lever 54 by the vacuum control device 73 must be sufficient to overcome the whole force exerted on the first control lever 54 by the temperature-sensitive element 53. At very low temperatures, e.g. −26° F., this force may be too great to allow the vacuum control device to operate the override lever **72*a***. As a result, too much fuel would be supplied to the engine under low load conditions.

According to the present invention, there is provided an automatic choke for a carburetor comprising a fuel enrichment valve 60 for controlling the flow of fuel into a carburetor; a temperature-sensitive element 53; a first operating lever 54 movable by the temperature-sensitive element into engagement with an end stop 100 at low temperatures; a second operating lever 57 for opening and closing the fuel enrichment valve 60 and movable with the first operating lever 54 so as to open the fuel enrichment valve 60 as the first operating lever 54 moves towards the end stop; and an override lever **72*a* operable by a vacuum operated control device 73 in response to vacuum in the manifold of the engine to which the carburetor is attached to effect closure of the fuel enrichment valve 60, characterized in that the first operating lever 54 moves the second operating lever 57 through a resilient connection 170 to open the fuel enrichment valve 60 at low temperatures, and in that the override lever 72*a* moves the second operating lever 57 against the bias of the resilient connection 170 to close the fuel enrichment valve 60** at low temperatures.

Since the override lever **72*a* moves the second lever 57 through the resilient connection rather than through the first lever 54, the maximum force required to move the first lever 54** so as to close the fuel enrichment valve at low temperatures will be the force exerted on the second lever by the resilient connection. This can easily be selected to fall within the range of force normally developed by the vacuum control device.

Additionally, this construction permits the use of a temperature sensitive element 53 which produces a relatively large deflection of the first operating lever 54 per degree of temperature change and thereby ensures that the enrichment valve 60 will always be fully closed as soon as the engine temperature has reached a desired minimum.

The resilient connection preferably comprises a spring 170. Where the first, second and override levers 54, 57 and **72*a* are mounted for pivotal movement about a common axis, the spring 170** is preferably in the form of a coil spring mounted coaxially with the said levers.

A preferred embodiment of the invention will now be described, by way of example only, with reference to the accompanying drawings, in which:

FIG. 5 is a vertical cross-sectional view taken on a plane indicated by and viewed in the direction of the arrows B—B of FIG. 3;

FIG. 6 is a partial vertical cross-sectional view taken on a plane indicated by and viewed in the direction of the arrows P—P of FIG. 5;

FIGS. 8 and 9 are cross-sectional views planes indicated by and viewed in the direction of arrows B—B and A—A, respectively of FIG. 7;

FIGS. 11 and 12 are end views of two parts of the automatic choke.

Figure 4:
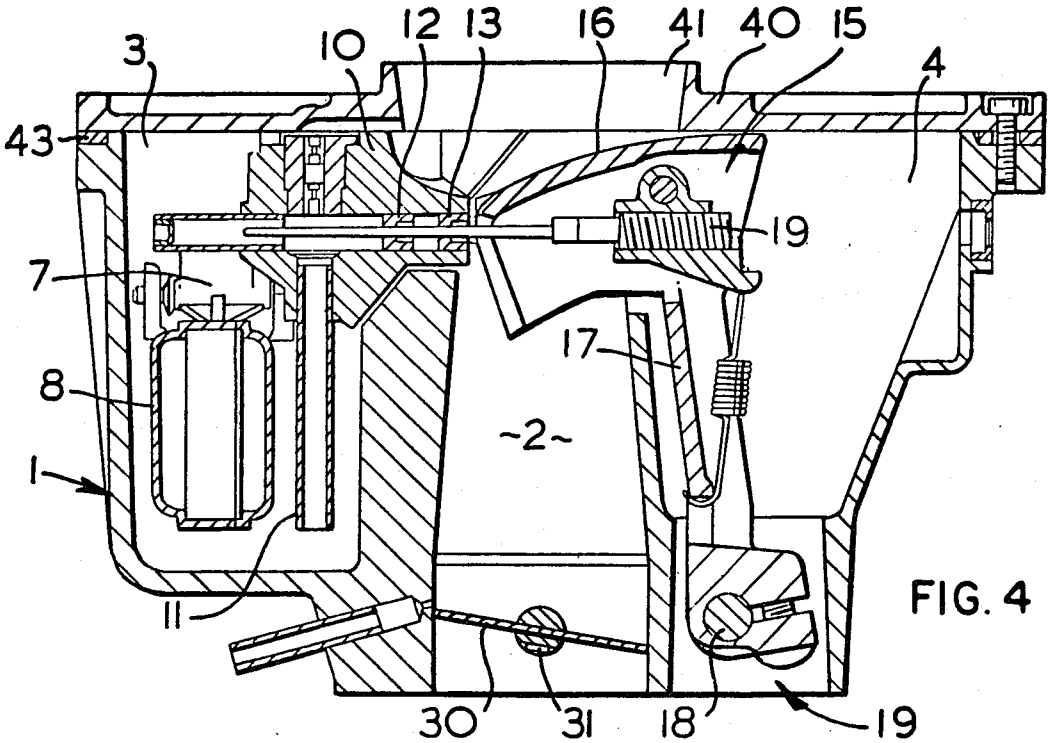
FIG. 4 is a vertical cross-sectional view taken on a plane indicated by and viewed in the direction of the arrows A—A of FIG. 1.

The drawings illustrate a carburetor of the type shown and described in the above-mentioned U.S. Ser. No. 270,532 incorporating an automatic choke according to the invention. The construction of the carburetor is as follows. The carburetor comprises a main housing 1 which is formed as a unitary casting. The housing 1 defines an induction passage 2, (see FIG. 4) which extends downwardly through the casting, and two upwardly-opening cavities, 3, 4 on opposite sides of the induction passage 2.

Figure 1:
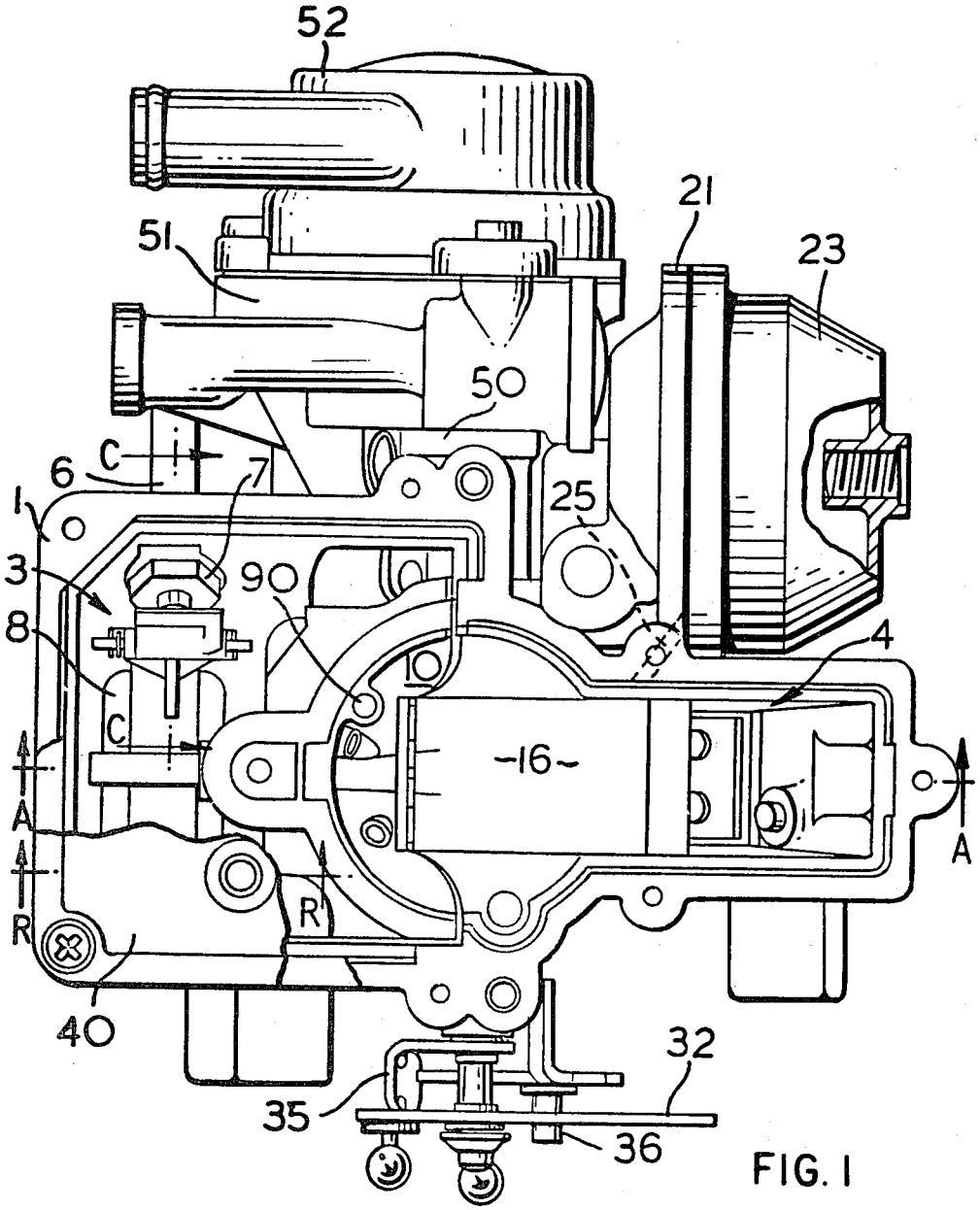
FIG. 1 is a plan view of a carburetor incorporating a choke constructed according to the invention.

The first cavity 3 constitutes a float chamber and receives fuel via an inlet 6 (FIG. 1). The flow of fuel through the inlet 6 is controlled by a valve assembly 7 which is operated by a float 8 pivotally mounted on the valve assembly.

A main jet block 10 is mounted in the housing in an upwardly open recess 11 between the induction passage 2 and the cavity 3 of the float chamber. The jet block 10 includes a supply pipe 11, which is normally immersed in fuel, and two main jets 12, 13 which lie in a horizontal bore adjacent the wall of the induction passage 2.

The second cavity 4 houses a movable venturi member 15. The venturi member 15 comprises a vane 16 and a stem 17 which is mounted on one end of a layshaft 18 extending transversely through the casting 1. Rotation of the layshaft 18 (FIG. 5) about its axis causes the vane 16 of the venturi member to move into and out of the recess 4 towards and away from the jet block 10. Movement of the vane 16 is facilitated by a coating of fluorinated hydrocarbon polymer. A metering needle 19 pivotally mounted in the vane 16 of the venturi member 15 projects from the venturi member and is received in the jets 12, 13.

Referring to FIG. 5, the other end of the layshaft 18 carries an arm 20 which extends vertically upwardly into a flanged mounting 21 formed integrally with the housing 1. A vacuum motor 23 (FIG. 1) of conventional construction is secured to the mounting 21 and is arranged to rotate the arm 20, and therefore the layshaft 18, about the axis of the layshaft in response to variation in the pressure in the cavity 4 which is communicated to the vacuum motor along a passage 25 (FIG. 1) extending through the housing 1 into the mounting 21.

A throttle valve (FIG. 4) is positioned in the induction passage 2 down-stream from the venturi member 15. The throttle valve comprises a plate 30 mounted on a rotatable shaft 31 for movement between a closed position, in which the plate is generally horizontal, and an open position, in which the plate is vertical. Rotation of the plate 30 is effected by means of levers 32, 35 (FIG. 1) mounted on the exterior of the housing 1.

The housing 1 is covered by a flat plate 40 which is bolted to the housing 1. It is sealed thereto by means of a single gasket 43 which extends around the periphery of the housing 1 and across the dividing wall between the fuel chamber cavity 3 and the recess for the jet block 10.

Figure 3:
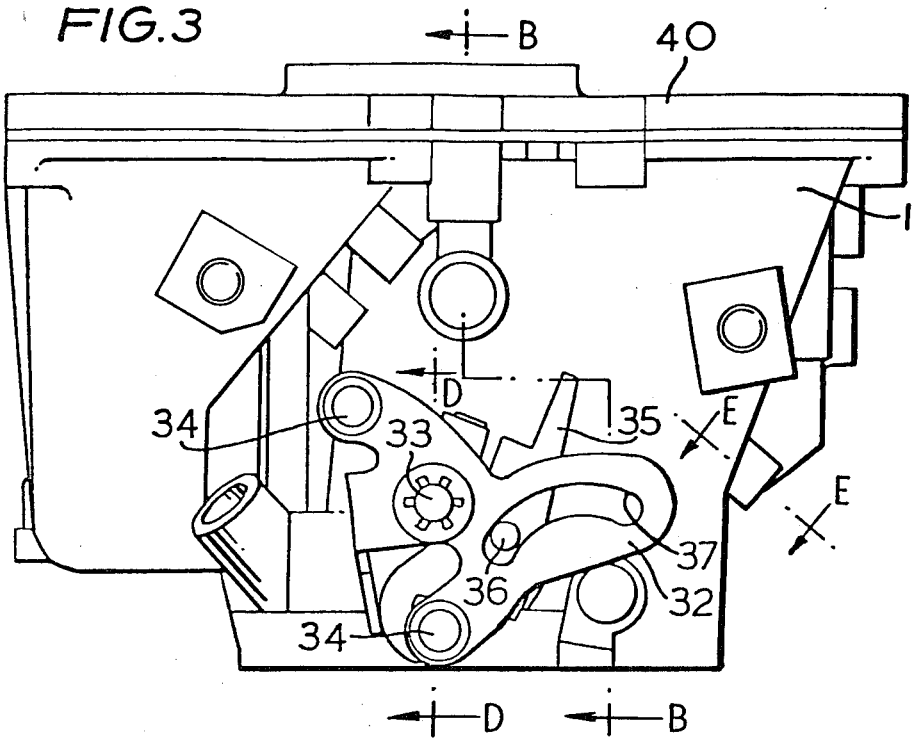
FIG. 3 is a side view of the carburetor.

The operation of the carburetor is as follows. In use, with the engine running and the throttle valve 30 open, air is drawn into the induction passage 2 through the inlet orifice 41 and passes through the venturi formed by the venturi member 15. The reduced pressure formed at the tip of the vane 16 of the venturi member 15 draws fuel from the fuel chamber 3 through the jets 12, 13 and into the induction passage 2, the quantity of fuel supplied to the induction passage 2 being controlled by the metering needle 19. The vacuum in the cavity 4 is applied to the vacuum motor 23. As the pressure in the manifold decreases, the vacuum motor causes the venturi member 15 to move clockwise as seen in FIG. 3 about the axis of the layshaft 18. The cross-sectional area of the venturi in the induction passage 2 is therefore increased so that the pressure at the venturi remains substantially constant.

AUTOMATIC CHOKE

Figure 2:
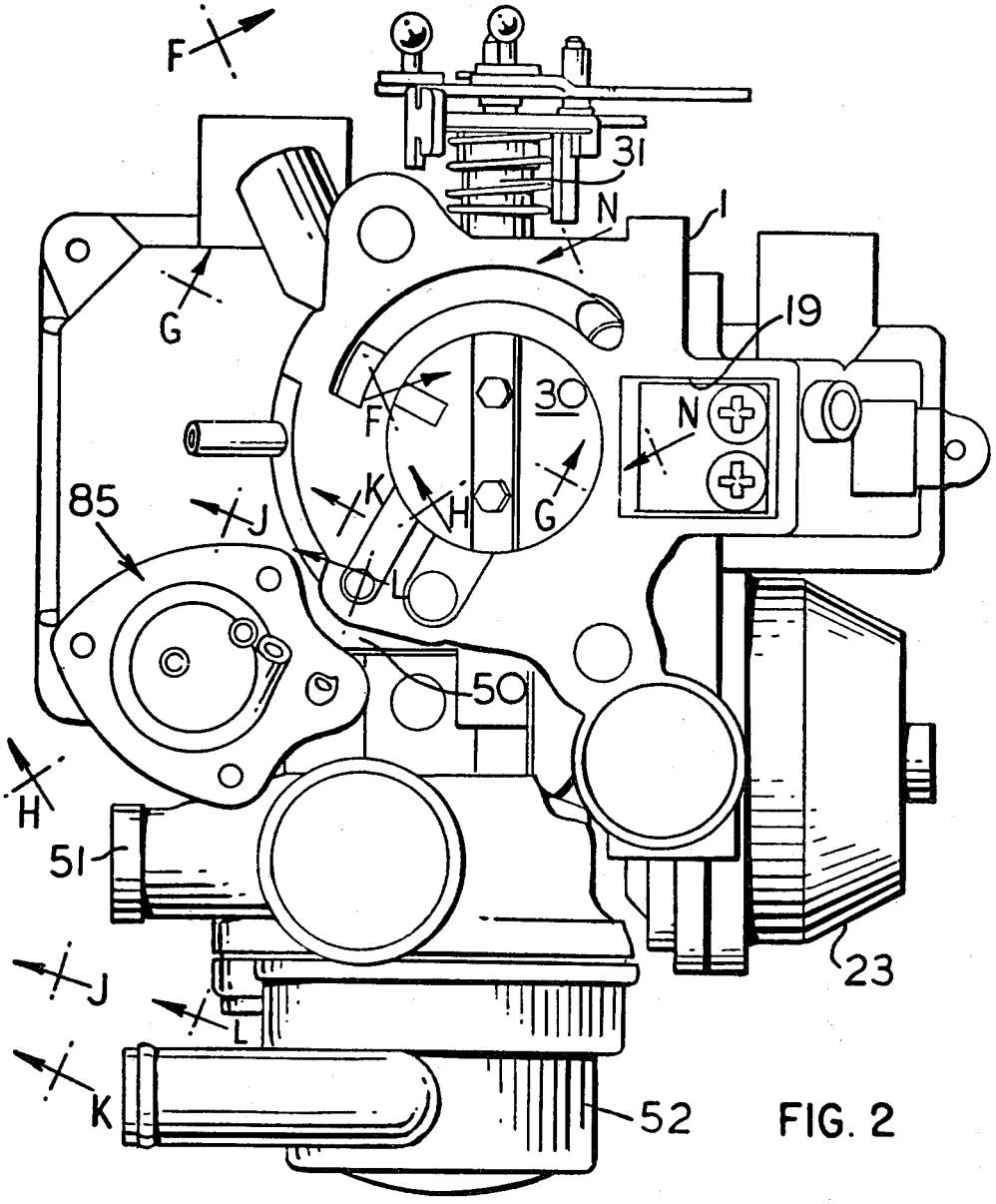
FIG. 2 is a plan view of the bottom of the carburetor looking upwardly.
Figure 10:
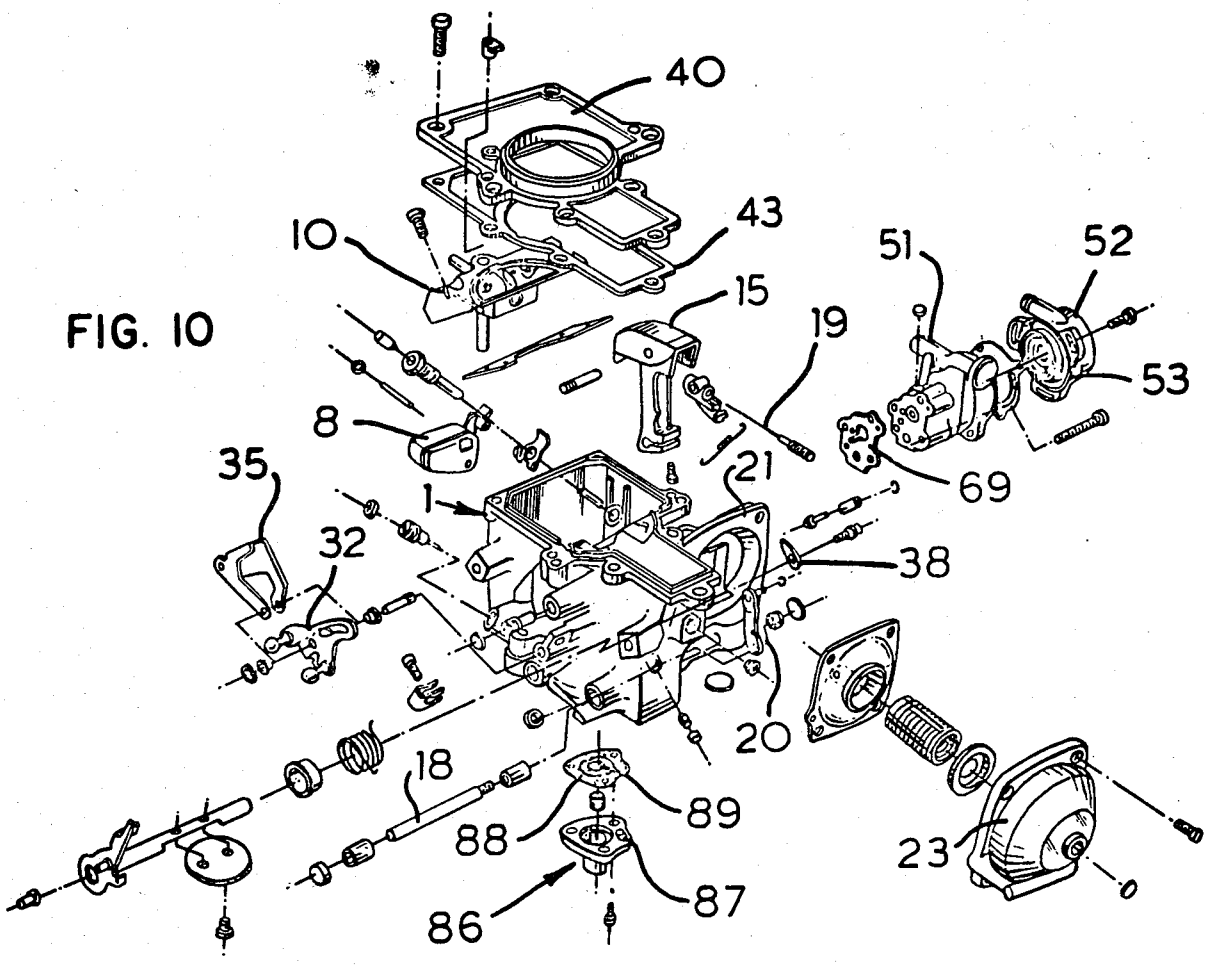
FIG. 10 is an "exploded" perspective view of the carburetor.

As seen in FIGS. 1 and 2, the housing 1 also incorporates an integral mounting 50 for an automatic choke device in accordance with the invention. Referring to FIGS. 7 and 10 to 12, the automatic choke device comprises a choke housing 51 and a water jacket 52 (FIG. 10). The water jacket 52 receives coolant water from the inlet manifold on which the carburretor is mounted. A bimetallic coil spring 53 is housed in the jacket 52 and is connected to one end 54*a* of a first operating lever 54 (FIG. 12). The lever 54 is fixed to a spindle valve 55 (FIG. 9) which is rotatable in a bore in the choke housing 51. A stop 100 (FIG. 7) on the housing limits the movement of the lever 54 in the anti-clockwise direction. The other arm 54*b* of the lever 54 carries a tab 56 which is arranged to engage an arm 57*a* on a second operating lever 57 which is also mounted on the spindle valve 55 coaxially with the first lever 54 for rotation relative to the valve 55 and the lever 54.

Figure 11:
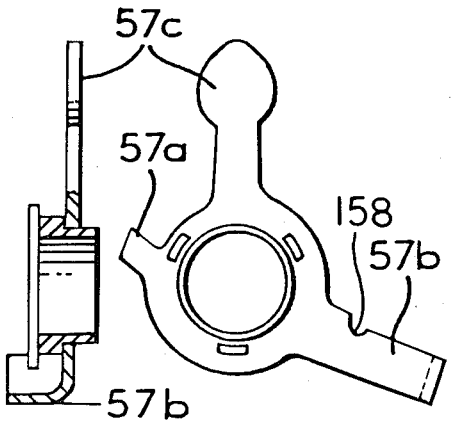
Figure 7:
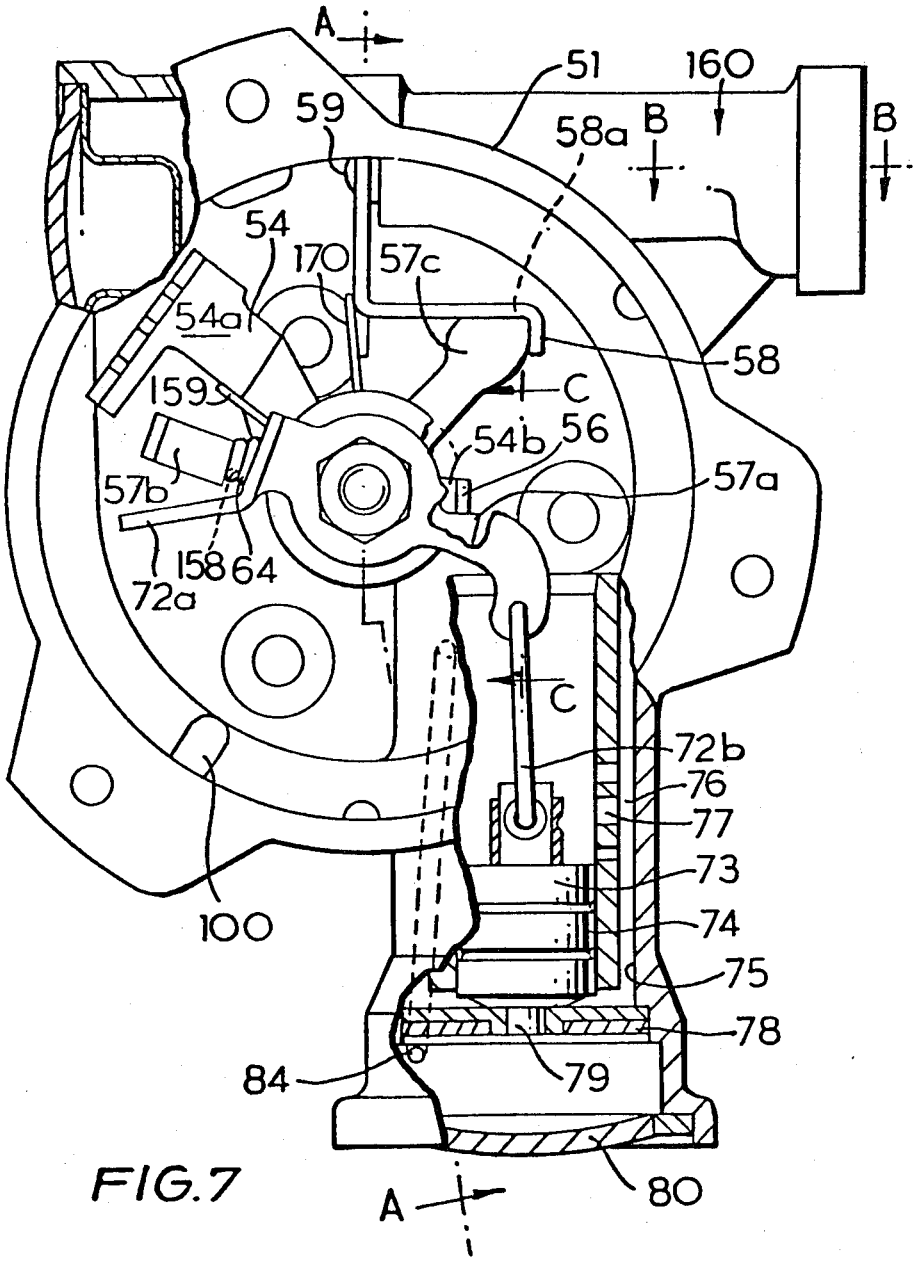
FIG. 7 is an end view of the choke mounted on the carburetor, with parts broken away and in section and with the cover removed.

As best seen in FIG. 11, the second operating lever 57 carries two further radial arms 57*b* and *c*. The second arm 57*b* includes a notch 158 which locates one end of a coil spring 64 the other end of which acts on the end 54*a* of the first operating lever 54 to which the bimetallic coil spring is attached. The spring 64 therefore acts as a resilient connection between the first and second operating levers 54 or 57 which biases them apart in clockwise and anticlockwise directions respectively as seen in FIG. 7, the tab 56 serving to act as a stop for the first operating lever 54.

The third arm 57*c* of the lever 57 engages in a slot 58*a* in a bracket 58 arranged tangentially to the direction of rotation of the end of the third arm 57*c*. A coil spring 170 biases the bracket 58 and the lever 57 in a clockwise direction as seen in FIG. 7.

The bracket 58 is attached to an operating rod 59 of a fuel enrichment valve 160. The latter valve comprises a metering needle 60 (FIG. 8) formed on one end of the rod 59, and a metering orifice 61 positioned in a bore in the housing 51 within which the rod 59 is slidable. The movement of the needle 60 into and out of the orifice 61 controls the flow of fluid from an inlet passage 62 in the choke housing 51 on one side of the orifice 60 to an outlet passage 63 in the choke housing on the other side of the orifice 61. If desired the metering needle 60 may be floatingly mounted on the rod 59 to reduce the risk of the needle 60 jamming within the orifice 51. The inlet passage 62 receives fuel from a supply passage 62' (FIG. 6) in the casting 1 which has its outlet in the mounting 50 and which communicates with the fuel supply line 6 (FIG. 1). The outlet passage 63 terminates opposite the mounting 50 as indicated at 63' in FIG. 6.

The spindle valve 55 has an axial bore 65 (FIG. 9) which communicates at its inner end with a radial bore 66 in the spindle valve 55. Rotation of the spindle valve 55 about its axis brings the radial bore 66 into and out of registry with an outlet passage 68 in the choke housing 56.

The choke housing is scaled to the mounting 50 by means of a gasket 69 (FIGS. 9 and 10) which is slotted at 69*a* (FIG. 9) to effect communication between the outlet passage 63 from the metering orifice 61, the axial bore 65 in the spindle valve 55, and an internal passage 70 (FIGS. 6 and 1) in the housing 1 which communicates with the induction passage 2 below the venturi but above the throttle plate 30. A hole 69*b* in the gasket 69 also effects communication between the outlet passage 68 in the choke housing 56 and a further internal passage 71 in the housing 1 communicating with the induction passage 2 downstream of the throttle valve by means not shown.

In operation, when the engine is cold, the bimetallic coil spring 53 moves the lever 54 to which it is connected anticlockwise from the position shown in FIG. 7 towards the stop 100 in the housing 51 so that the lever 57 also is displaced anticlockwise from the position shown under the influence of the coil spring 64. The third arm 57*c* of the lever 57 travels to the opposite end of the slot 58*a* and then moves the rod 59 to the left as viewed in FIG. 7, thus opening the metering orifice 60. The spindle valve 55 also is rotated so that the radial bore 66 registers with the outlet passage 68. Reduced pressure in the induction passage downstream of the throttle valve will drawn an air/fuel mixture through the internal passage 71 from the induction passage 2 upstream of the throttle valve via the passage 70, the axial bore 65, the radial bore 66 and the outlet passage 68. The flow of mixture into the axial bore 65 by the manifold vacuum also draws fuel through the slot 69*a* in the gasket 69 from the inlet passage 62 via the metering orifice 61 and the outlet passage 63 into the axial bore 65. As a result, the air-fuel mixture entering the inlet manifold is enriched with fuel.

In an alternative embodiment, the fuel from the metering orifice 61 is not mixed with the fuel/air mixture in the axial bore 65 via the slotted gasket 69. Instead, the mounting 50 is provided with an additional fuel passageway which communicates at one end with the outlet passage 63 and at its other end with the jet block 10 (FIG. 4) to introduce the additional fuel between the two jets 12, 13. This arrangement has the advantage that the flow of additional fuel is modulated by the venturi in the induction passage rather than by the flow of fuel/air mixture into the axial bore 65 as in the embodiment described.

As the engine temperature increases, the bimetallic coil 53 moves the lever 54 clockwise (FIG. 7). Since the end 56 of the lever 54 is in engagement with the end 57*a* of the arm 57, the lever 57 also moves clockwise. This allows the rod 59 to move to the right as seen in FIG. 7 under the influence of the spring 170 to close the metering orifice 61. At the same time the spindle valve 55 is rotated with the lever 54 so that the radial bore 66 is moved out of registry with the outlet passage 68. The metering orifice 61 and the outlet passage 68 are not however closed simultaneously. Thus, when the operating lever 57 reaches the position in which the orifice 61 is closed, the lever 54 continues to rotate clockwise as the engine warms up, until the opposite arm 57*c* of the lever 57 engages the opposite end of the slot 58*a* in the bracket 58. During this movement, the radial bore 66 is still partly in registry with the outlet passage 68 so that additional air/fuel mixture from down-stream of the venturi by-passes the throttle plate 30 via the automatic choke device. As a result, the automatic choke feeds an initiallly fuel-rich mixture to the induction passage 2 to facilitate starting and cold-running of the engine. Whilst the engine is warm, but not at its maximum operating temperature, the choke device supplies additional fuel-air mixture to the engine so that the engine has an increased idle speed. When the engine reaches its operating temperature, the metering orifice 61 is fully closed and the radial bore 66 in the spindle valve 55 is fully out of registry with the outlet passage 68. Neither fuel nor air is therefore fed into the induction passage 2 from the automatic choke device.

Although additional fuel is required for starting the engine and during initial warm-up, the amount of additional fuel needed varies with the load on the engine. Thus, more additional fuel will be required under high load conditions, e.g. when accelerating, than under low load conditions. In order to reduce the quantity of fuel added to the engine at low loads, an override lever 72 is mounted on the end of the spindle valve 55 and is rotatable thereon. One arm 72*a* of the override lever 72 is arranged to engage the arm 57*b* of the bell-crank lever 54. The other arm 72*b* of the lever 72 is attached to a vacuum operated control mechanism which moves the lever 72 in response to vacuum in the manifold of the engine to which the carburettor is connected. The control mechanism comprises a piston 73 which is reciprocable in a tube 74 mounted at one end within a cylindrical bore 75 in the choke housing. The part of the bore 75 surrounding the opposite end of the tube 74 is of larger diameter than the tube 74 so that an annular passage 76 is formed between the tube 74 and the bore 75. A series of radial bores 77 are formed in the tube 74 at intervals along its length. The movement of the piston 73 in the tube 74 is limited by a plate 78 having a central bore 79. The bore 75 is sealed by a cap 80. The space between the plate 78 and the cap 80 communicates with the induction passage 2 downstream of the throttle valve 30 via a passage 84 in the choke housing 56, a passage 84 in the casting 1 (FIG. 6) and a slot in the gasket (not shown) which seals the casting 1 in the manifold on which it is mounted. The side of the piston 73 adjacent the arm 72*b* is exposed to atmospheric pressure. At low loads the vacuum in the induction passage below the throttle valve is high. The piston 73 is drawn downwardly (as seen in FIG. 7) thus rotating the lever 72 clockwise (as seen in FIG. 7). When the engine is cold, this clockwise movement of the lever 72 will rotate the first operating lever 57 against the bias of the coil spring 64 reducing the amount of fuel and air supplied by the automatic choke device. As the piston travels down the tube 74 it uncovers progressively more of the radial bores 77 so that increasing quantities of air by-pass the piston 73 through the annular space 76 and the bore 79. Finer control over the position of the piston 73 is thereby obtained. When the engine load is increased, the piston 82 and the lever 80 are returned to the positions set by the bimetallic coil spring 85, thus supplying the additional fuel.

At low temperatures, the bimetallic coil spring 53 will hold the end 54*a* of the first operating lever 54 firmly in engagement with the stop 100 in the housing, and the force exerted on the lever 54 by the bimetallic coil spring 53 will increase as the temperature decreases. Such increases in the force on the lever 54 will not however increase the force which must be exerted on the override lever 72 to move the first operating lever because the compression of the spring 64 remains constant. The operation of the override lever 72 is therefore not affected by low temperatures. This also permits a relatively highly temperature sensitive bimetallic coil spring 53 to be used. The use of such a spring allows a more sensitive control of the operation of the automatic choke which facilitates adjustment of the choke to allow successful operation under critical operating conditions such as, for example, starting the engine when the engine block is cold but the coolant is warm.

I claim:

1. An automatic choke for a carburetor comprising a fuel enrichment valve for controlling the flow of fuel into a carburetor; a temperature-sensitive element; a first operating lever movable by the temperature-sensitive element into engagement with an end stop at low temperatures; a second operating lever for opening and closing the fuel enrichment valve and movable with the first operating lever so as to open the fuel enrichment valve as the first operating lever moves towards the end stop; and an override lever operable by a vacuum operated control device in response to vacuum in the manifold of the engine to which the carburetor is attached to effect closure of the fuel enrichment valve, characterised in that the first operating lever moves the second operating lever through a resilient connection to open the fuel enrichment valve at low temeratures, and in that the override lever moves the second operating lever against the bias of the resilient connection to close the fuel enrichment valve at low temperatures.

2. An automatic choke according to claim 1 wherein the resilient connection comprises a spring.

3. An automatic choke according to claim 2 wherein the first and second operating levers are mounted coaxially and the spring comprises a coaxial coil spring.

* * * * *